US009341063B2

(12) United States Patent
Lucas et al.

(10) Patent No.: US 9,341,063 B2
(45) Date of Patent: May 17, 2016

(54) FLUID DEVICE WITH ROLL POCKETS ALTERNATINGLY PRESSURIZED AT DIFFERENT PRESSURES

(75) Inventors: Jay P. Lucas, Plymouth, MN (US); Timothy I. Meehan, Waconia, MN (US)

(73) Assignee: Eaton Corporation, Cleveland, OH (US)

( * ) Notice: Subject to any disclaimer, the term of this patent is extended or adjusted under 35 U.S.C. 154(b) by 247 days.

(21) Appl. No.: 13/881,442

(22) PCT Filed: Oct. 28, 2011

(86) PCT No.: PCT/US2011/058272

§ 371 (c)(1), (2), (4) Date: Jul. 25, 2013

(87) PCT Pub. No.: WO2012/058527

PCT Pub. Date: May 3, 2012

(65) Prior Publication Data

US 2014/0147321 A1 May 29, 2014

Related U.S. Application Data

(60) Provisional application No. 61/408,318, filed on Oct. 29, 2010.

(51) Int. Cl.
*F01C 1/10* (2006.01)
*F01C 1/04* (2006.01)
(Continued)

(52) U.S. Cl.
CPC . *F01C 1/04* (2013.01); *F01C 1/105* (2013.01); *F01C 20/06* (2013.01); *F01C 21/045* (2013.01); *F04C 2/104* (2013.01); *F04C 2/105* (2013.01); *F01C 1/086* (2013.01); *F01C 21/18* (2013.01)

(58) Field of Classification Search
CPC ..... F04C 2/103–2/105; F04C 2/36; F04C 15/0088; F04C 15/06; F01C 1/104; F01C 1/105
USPC ..... 418/61.1, 61.3, 72, 123, 124, 166, 167, 418/232, 246, 249, 263, 267, 268, 171, 418/264; 417/410.4, 410.5
See application file for complete search history.

(56) References Cited

U.S. PATENT DOCUMENTS 2,905,095 A 9/1959 Hartmann et al.
3,401,641 A * 9/1968 Adams et al. ..... 418/268
(Continued)

FOREIGN PATENT DOCUMENTS

GB 1 394 128 5/1975

OTHER PUBLICATIONS

International Search Report and Written Opinion for PCT/US2011/058272 mailed Jun. 26, 2013.
(Continued)

*Primary Examiner* — Jesse Bogue
*Assistant Examiner* — Laert Dounis
(74) *Attorney, Agent, or Firm* — Merchant & Gould P.C.

(57) ABSTRACT

A method for pressurizing a roll pocket of a displacement assembly of a fluid device includes providing a fluid device having a displacement assembly. The displacement assembly includes a ring defining a central bore and roll pockets disposed about the central bore. Rolls are disposed in the roll pockets. A rotor is disposed in the central bore. The ring, the rolls and the rotor define a plurality of expanding and contracting volume chambers. Fluid is communicated from a first port of the fluid device and a second port of the fluid device to each of the roll pockets so that when the volume chamber immediately before one of the roll pockets and the volume chamber immediately after that roll pocket are both in fluid communication with one of the first and second ports, that roll pocket is in fluid communication with the other of the first and second ports.

23 Claims, 13 Drawing Sheets

(51) Int. Cl.

| | |
|---|---|
| ***F04C 2/10*** | (2006.01) |
| ***F01C 20/06*** | (2006.01) |
| ***F01C 21/04*** | (2006.01) |
| *F01C 1/08* | (2006.01) |
| *F01C 21/18* | (2006.01) |

(56) References Cited

U.S. PATENT DOCUMENTS

| | | | | |
|---|---|---|---|---|
| 3,591,320 | A | 7/1971 | Woodling | |
| 3,680,987 | A * | 8/1972 | Ohrberg | F01C 1/10 418/61.3 |
| 3,692,439 | A | 9/1972 | Woodling | |
| 3,718,411 | A * | 2/1973 | Pollman | F04C 2/3566 418/131 |
| 3,915,603 | A | 10/1975 | Swedberg | |
| 3,930,766 | A | 1/1976 | Swedberg | |
| 4,008,015 | A | 2/1977 | McDermott | |
| 4,082,480 | A | 4/1978 | McDermott | |
| 4,480,971 | A * | 11/1984 | Swedberg | 418/61.3 |
| 7,530,801 | B2 | 5/2009 | Hicks | |
| 7,726,958 | B2 | 6/2010 | Pedersen et al. | |

OTHER PUBLICATIONS

"Industrial Hydraulics Manual: Your Comprehensive Guide to Industrial Hydraulics", Eaton Corporation, Eaton Fuid Power Training, 2010, Chapter 7: Hydraulic Actuators, pp. 147-182.

* cited by examiner

FLUID DEVICE WITH ROLL POCKETS ALTERNATINGLY PRESSURIZED AT DIFFERENT PRESSURES

CROSS REFERENCE TO RELATED APPLICATION

This application is a National Stage Application of PCT/US2011/058272, filed 28 Oct. 2011, which claims benefit of U.S. Patent Application Ser. No. 61/408,318 filed on 29 Oct. 2010, and which applications are incorporated herein by reference. To the extent appropriate, a claim of priority is made to each of the above disclosed applications.

TECHNICAL FIELD

The present disclosure relates generally to fluid pumps/motors. More particularly, the present disclosure relates to orbiting gerotor type fluid pumps/motors.

BACKGROUND

An orbiting gerotor motor includes a set of matched gears having a stationary outer ring gear and a rotating inner gear (i.e., a rotor). The inner gear is coupled to an output shaft such that torque can be transferred from the inner gear to the shaft. The outer ring gear has one more tooth than the inner gear. A commutator valve plate rotates at the same rate as the inner gear. The commutator valve plate provides drive fluid pressure and tank fluid pressure to selected displacement chambers between the inner and outer gears to rotate the inner gear relative to the outer gear. Certain georotor motors have been designed with rollers incorporated into the displacement chambers between the inner gears and the outer gears. An example of this type of motor is the Geroler® hydraulic motor sold by Eaton Corporation. In this design, the rollers reduce wear and friction thereby allowing the motors to be efficiently used in higher pressure applications. While such rollers provide enhanced efficiency and friction reduction, further improvements are desirable in this area.

SUMMARY

An aspect of the present disclosure relates to a fluid device. The fluid device includes a valve member defining a first plurality of fluid passages in fluid communication with a first fluid port of the fluid device and a second plurality of fluid passages in fluid communication with a second fluid port of the fluid device. A displacement assembly is in commutating fluid communication with the valve member. The displacement assembly includes a ring defining a central bore and a plurality of roll pockets disposed about the central bore. A plurality of rolls is disposed in the plurality of roll pockets. A rotor is disposed in the central bore. The ring, the plurality of rolls and the rotor defining a plurality of expanding and contracting volume chambers. Fluid is communicated to each of the roll pockets so that when the volume chambers immediately adjacent to one of the roll pockets are in fluid communication with one of the first and second ports, that roll pocket is in fluid communication with the other of the first and second ports.

Another aspect of the present disclosure relates to a fluid device. The fluid device includes a valve housing defining a first fluid port and a second fluid port. A valve member is disposed in the valve housing. The valve member defines a first plurality of fluid passages in fluid communication with the first fluid port and a second plurality of fluid passages in fluid communication with the second fluid port. The valve member has a first axial end. A valve plate has a valve surface that contacts the first axial end of the valve member. The valve plate defines a plurality of commutating passages and a plurality of recesses. The commutating passages are in commutating fluid communication with the first and second pluralities of fluid passages of the valve member. A displacement assembly is in commutating fluid communication with the valve member. The displacement assembly includes a ring defining a central bore and a plurality of roll pockets disposed about the central bore. A plurality of rolls is disposed in the plurality of roll pockets. A rotor is disposed in the central bore. The ring, the plurality of rolls and the rotor defining a plurality of expanding and contracting volume chambers. Fluid from the first and second ports is communicated to each of the roll pockets during movement of the rotor so that when the volume chamber immediately before one of the roll pockets and the volume chamber immediately after that roll pocket are both in fluid communication with one of the first and second ports, that roll pocket is in fluid communication with the other of the first and second ports.

Another aspect of the present disclosure relates to a method for pressurizing a roll pocket of a displacement assembly of a fluid device. The method includes providing a fluid device having a displacement assembly. The displacement assembly includes a ring defining a central bore and a plurality of roll pockets disposed about the central bore. A plurality of rolls is disposed in the plurality of roll pockets. A rotor is disposed in the central bore. The ring, the plurality of rolls and the rotor define a plurality of expanding and contracting volume chambers. Fluid is communicated from a first port of the fluid device and a second port of the fluid device to each of the roll pockets so that when the volume chamber immediately before one of the roll pockets and the volume chamber immediately after that roll pocket are both in fluid communication with one of the first and second ports, that roll pocket is in fluid communication with the other of the first and second ports.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DRAWINGS

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
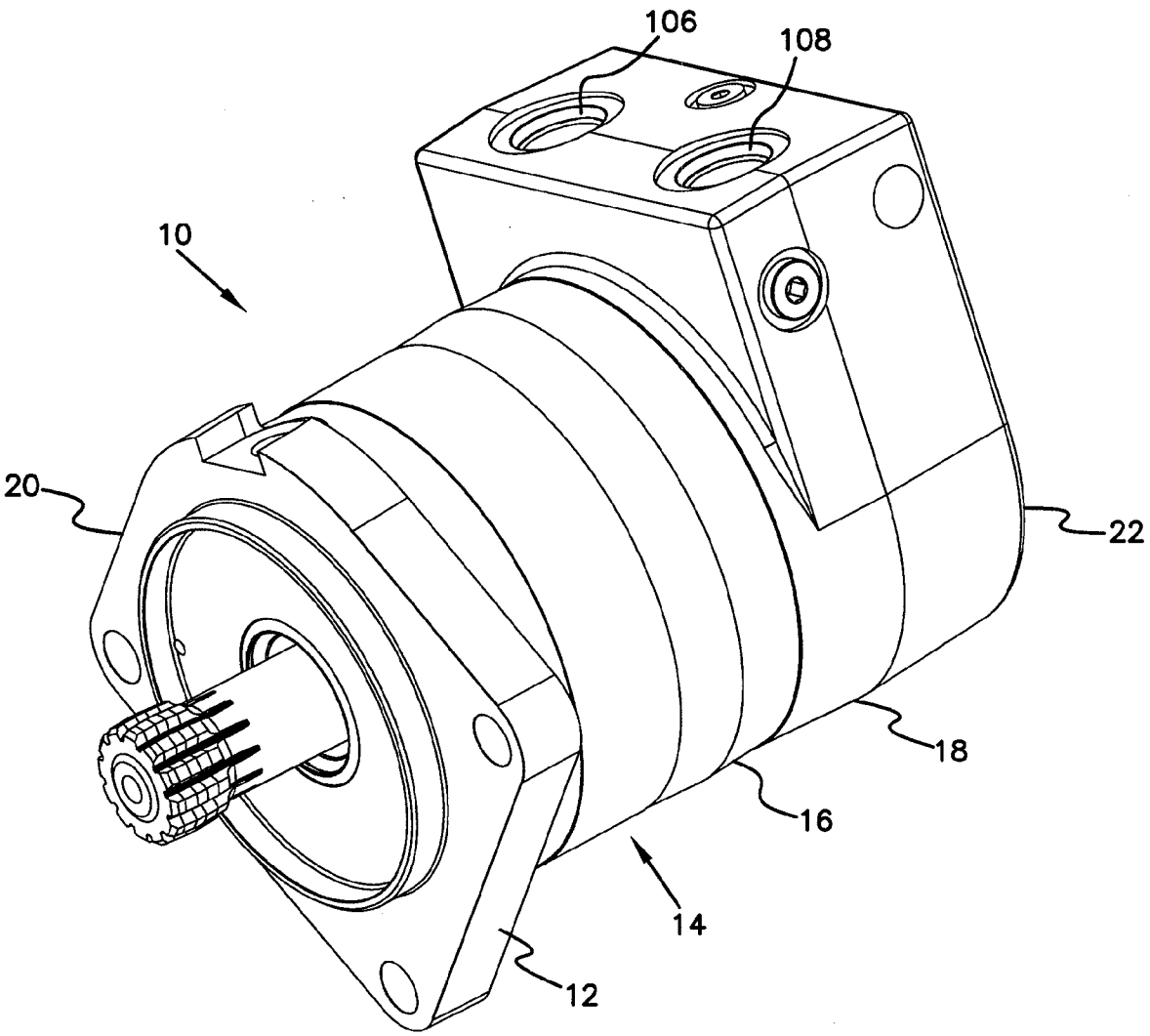
FIG. 1 is a perspective view of a fluid device having exemplary features of aspects in accordance with the principles of the present disclosure.
Figure 2:
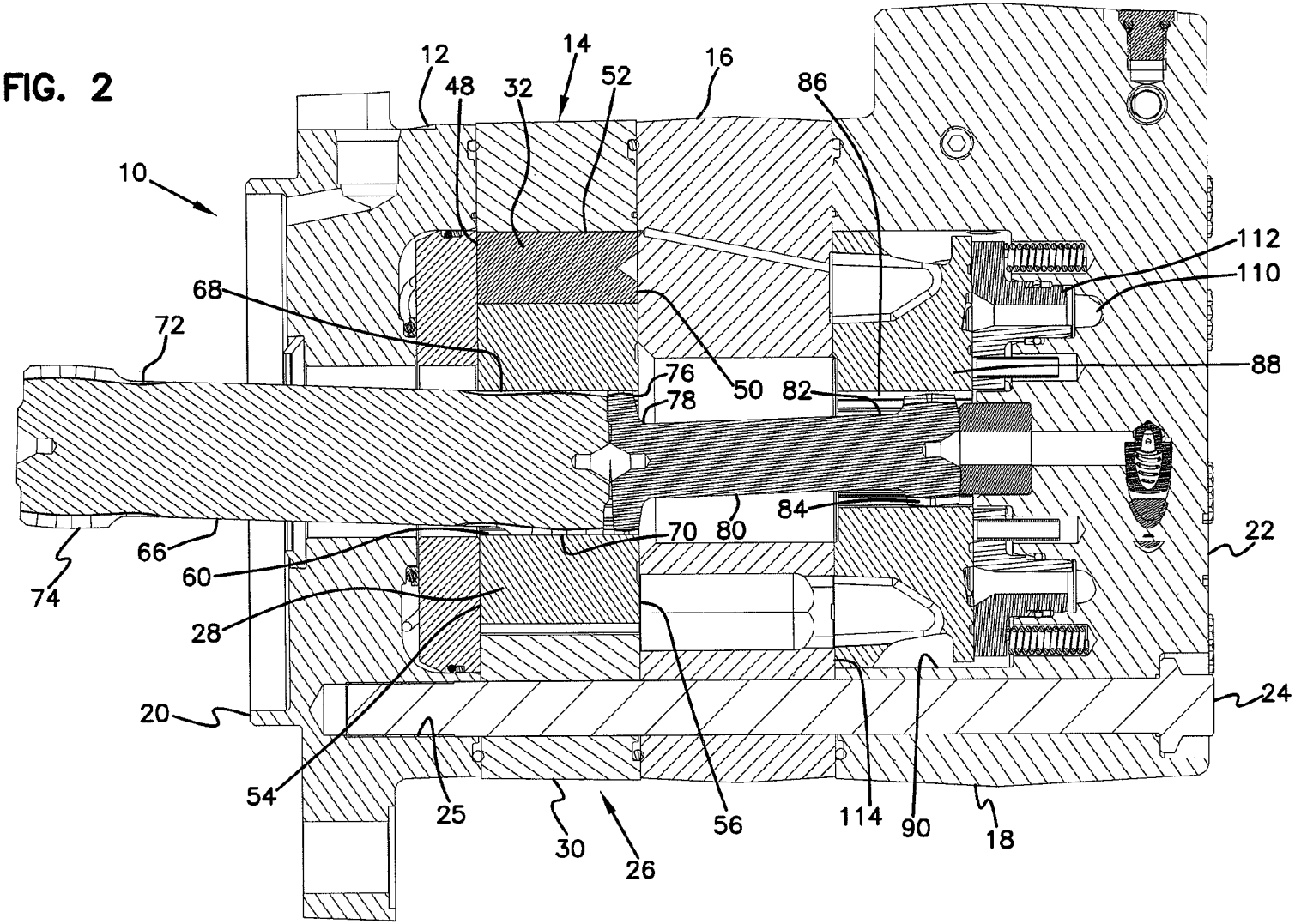
FIG. 2 is a cross sectional view of the fluid device of FIG. 1.
Figure 3:
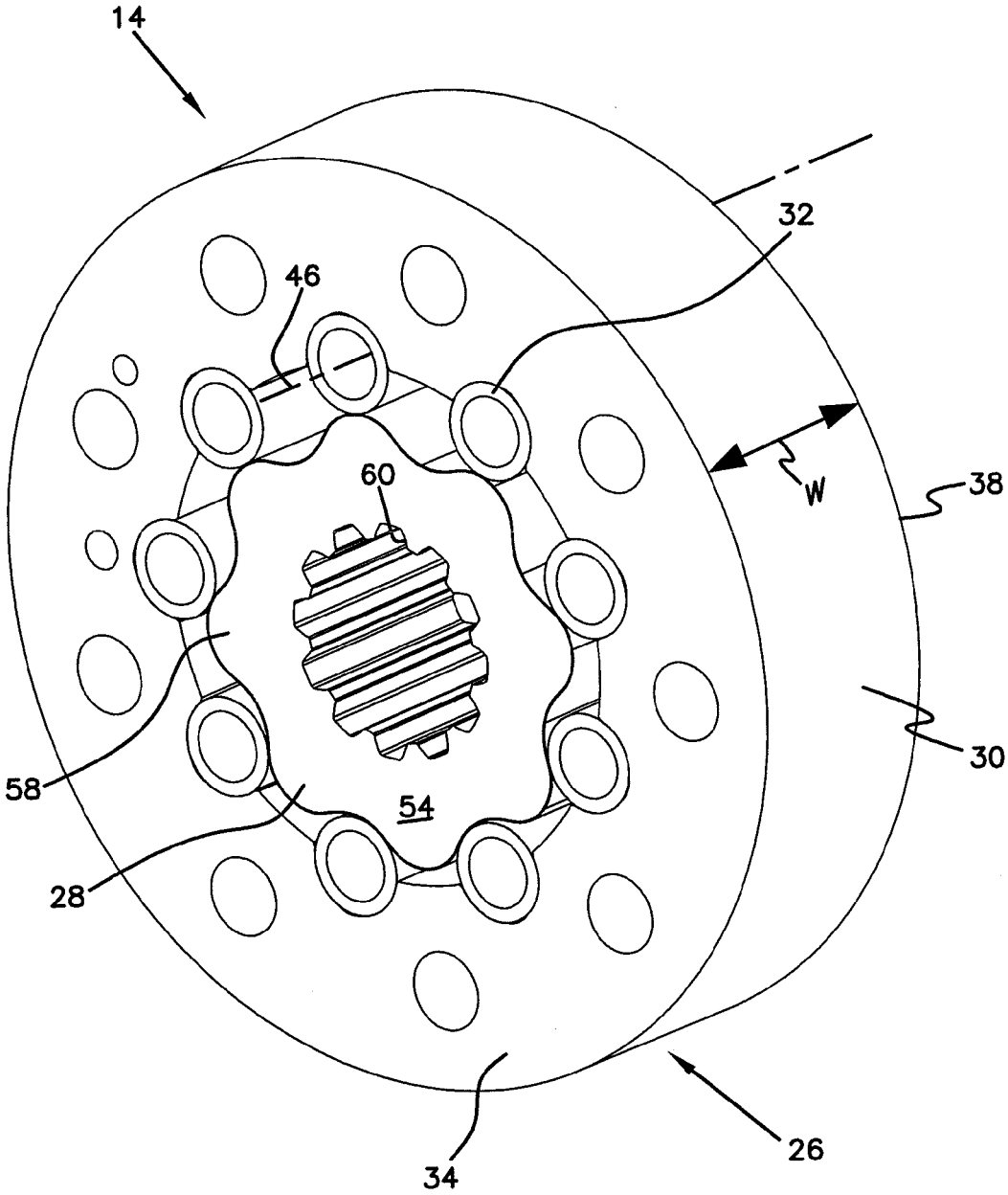
FIG. 3 is a perspective view of a displacement assembly suitable for use in the fluid device of FIG. 1.
Figure 4:
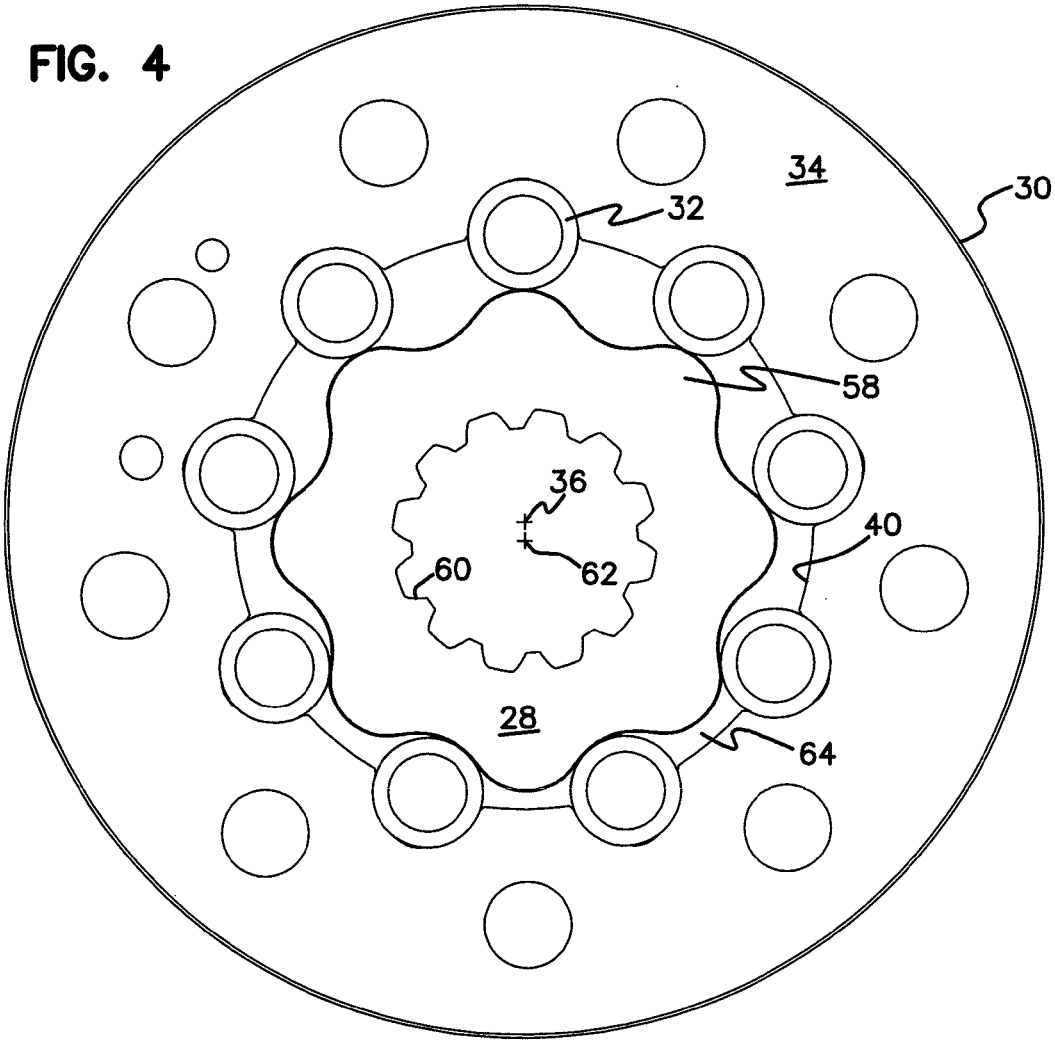
FIG. 4 is a front view of the displacement assembly of FIG. 3.
Figure 13:
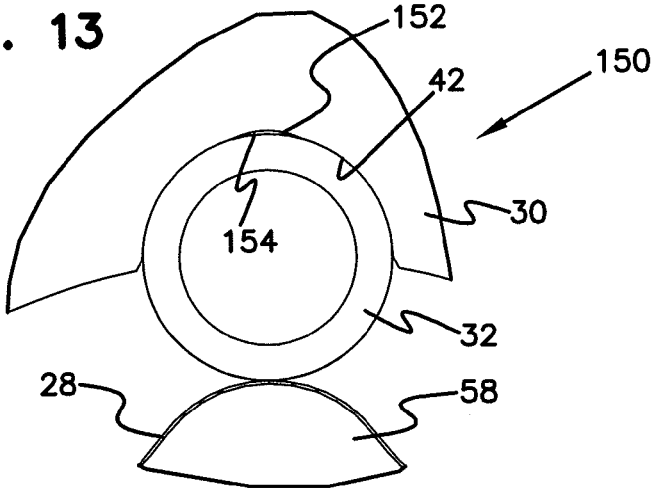
FIG. 13 is an enlarged fragmentary view of a roll in a roll pocket of the displacement assembly of FIG. 4.
Figure 5:
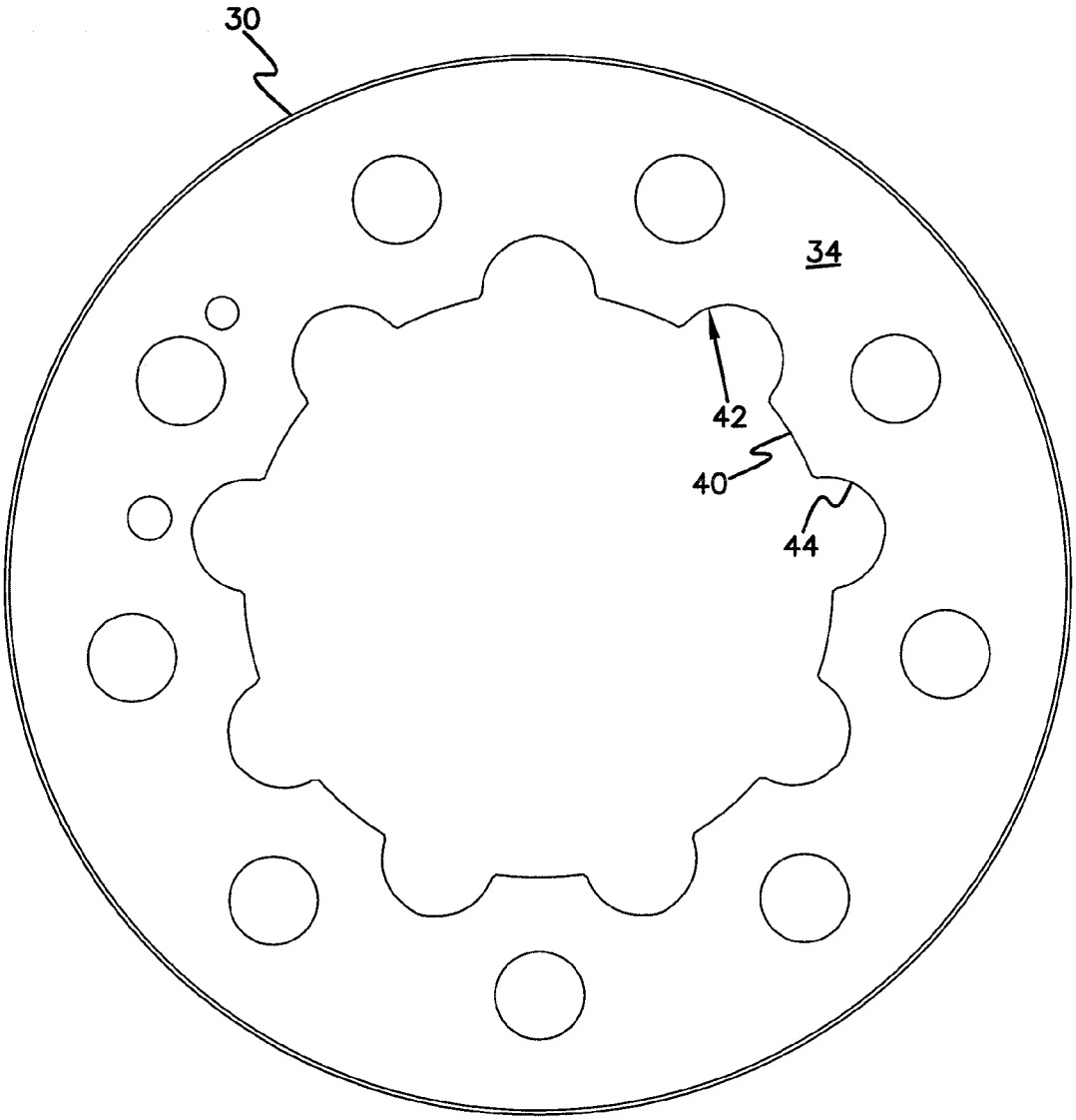
FIG. 5 is a front view of a ring suitable for use with the displacement assembly of FIG. 4.
Figure 6:
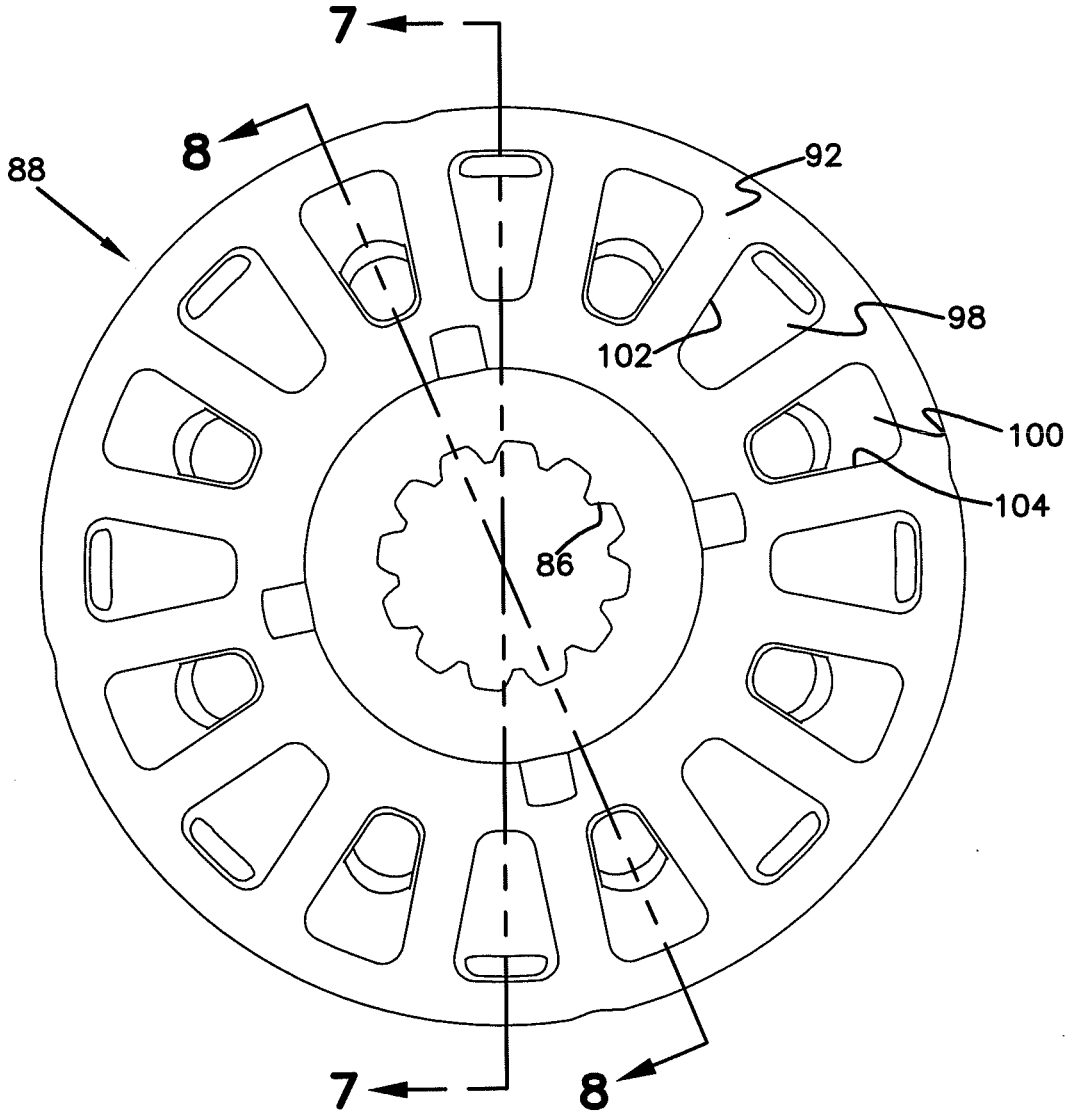
FIG. 6 is a view of a first axial end of a valve member that is suitable for use in the fluid device of FIG. 1.
Figure 7:
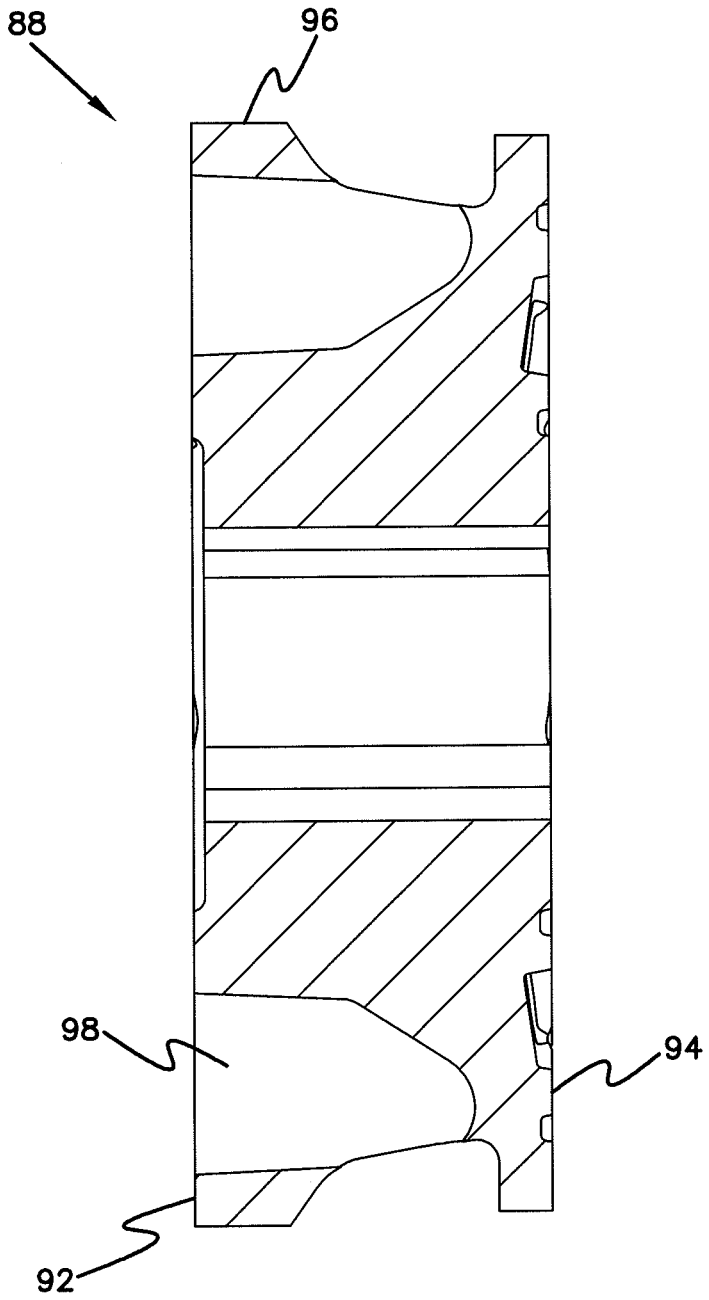
FIG. 7 is a cross-sectional view of the valve member taken on line 7-7 of FIG. 6.
Figure 8:
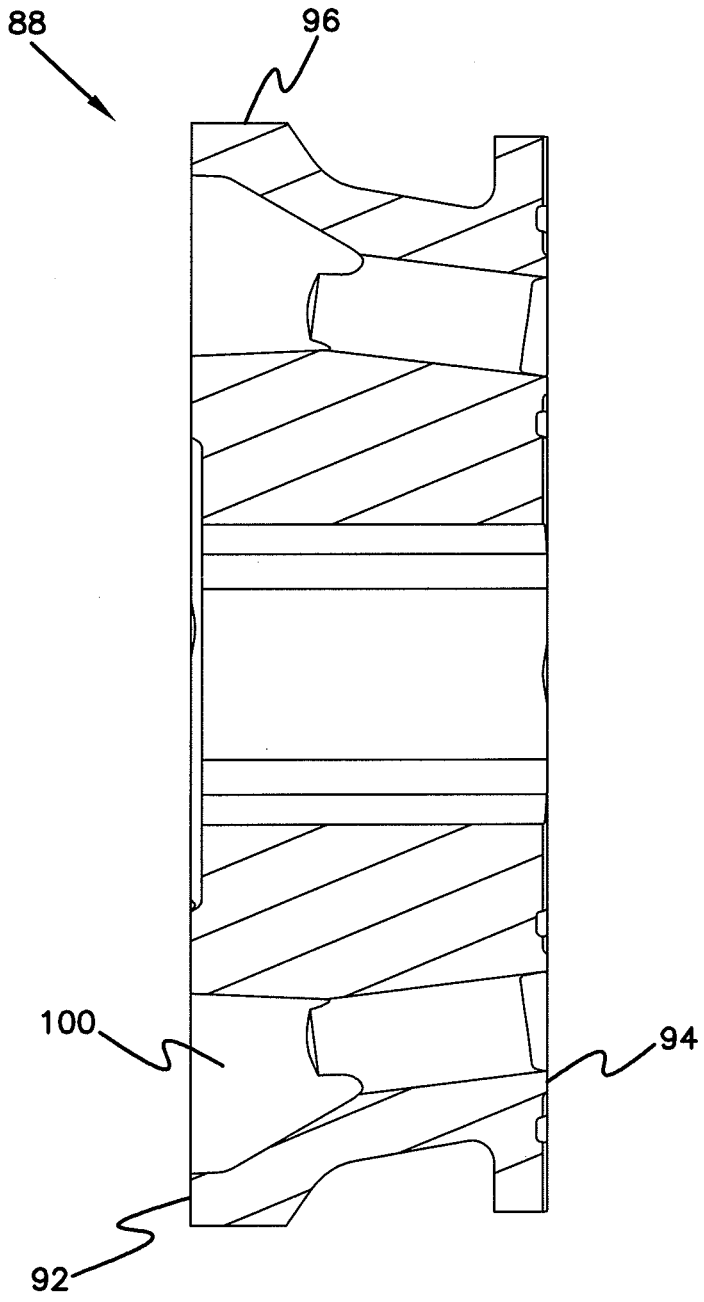
FIG. 8 is a cross-sectional view of the valve member taken on line 8-8 of FIG. 6.
Figure 9:
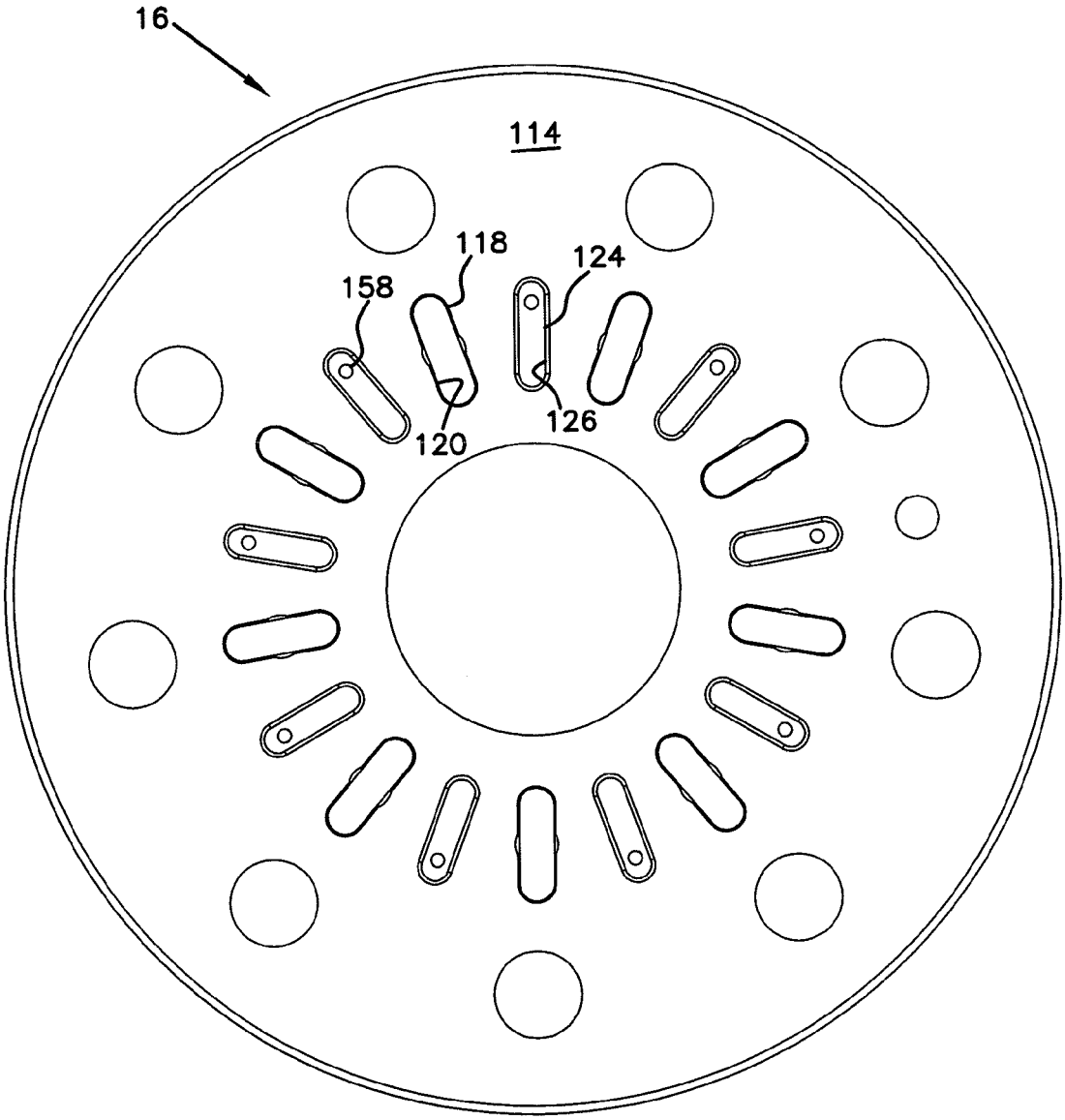
FIG. 9 is a view of a valve surface of a valve plate that is suitable for use in the fluid device of FIG. 1.
Figure 10:
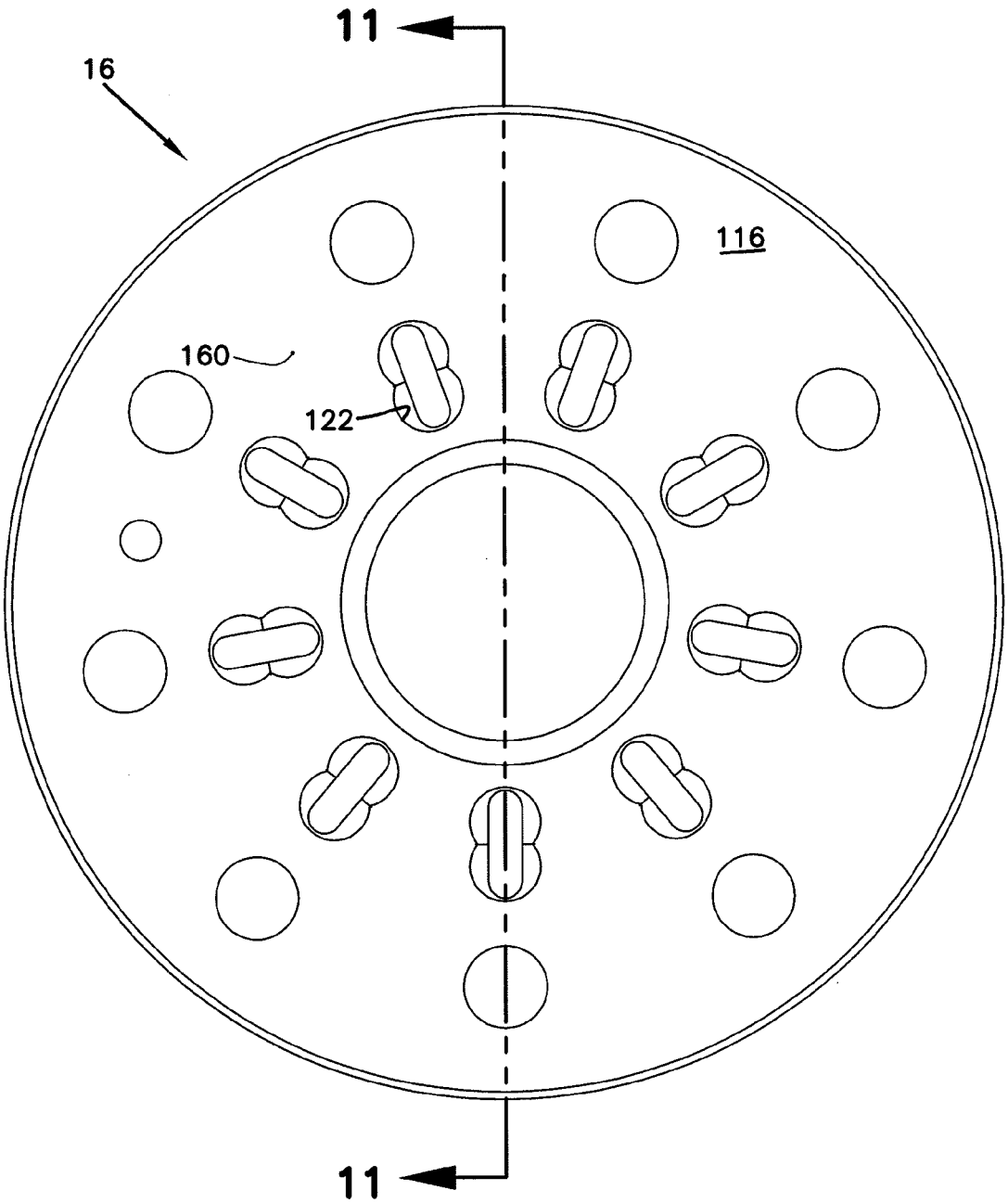
FIG. 10 is a view of a ring surface of the valve plate.
Figure 11:
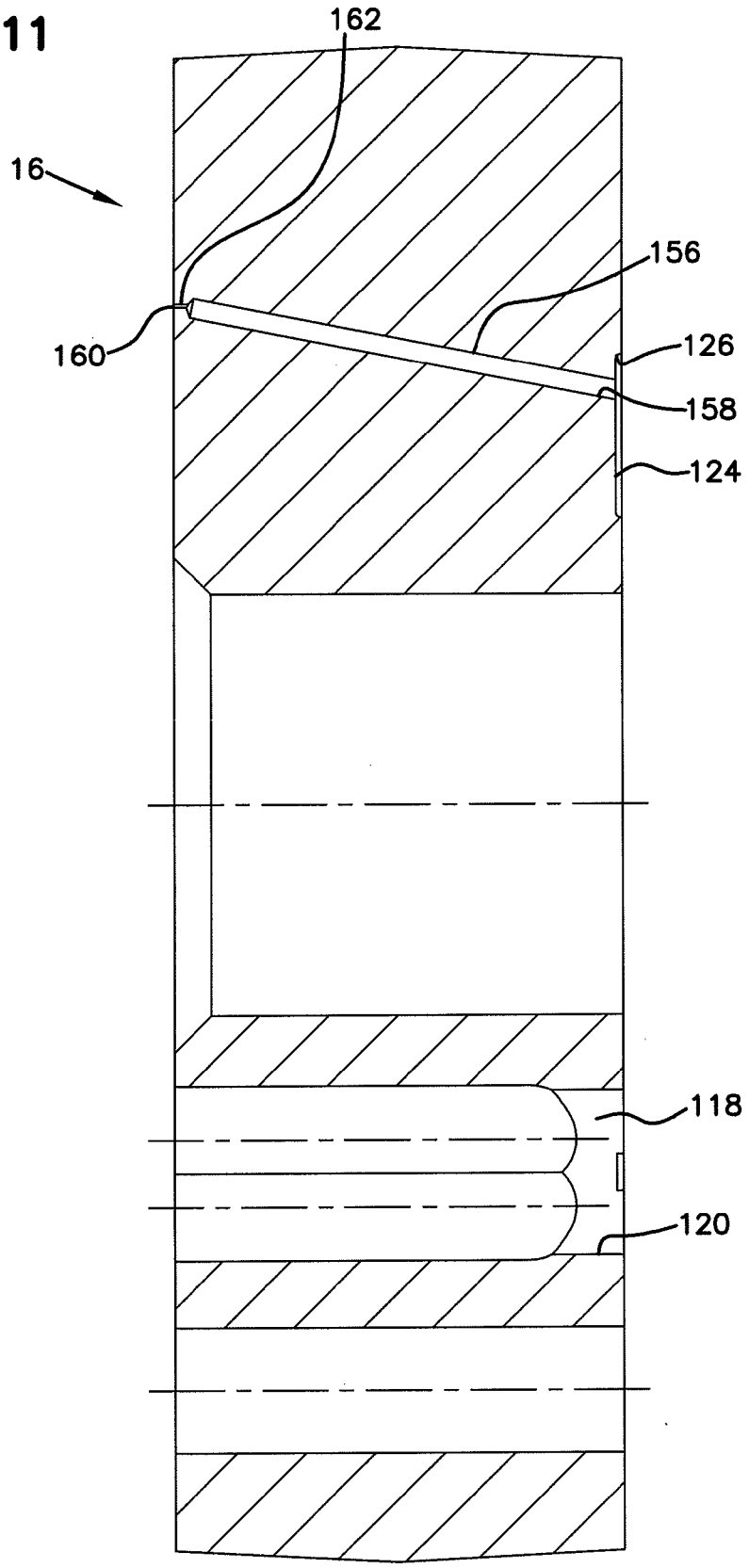
FIG. 11 is a cross-sectional view of the valve plate taken on line 11-11 of FIG. 10.
Figure 12:
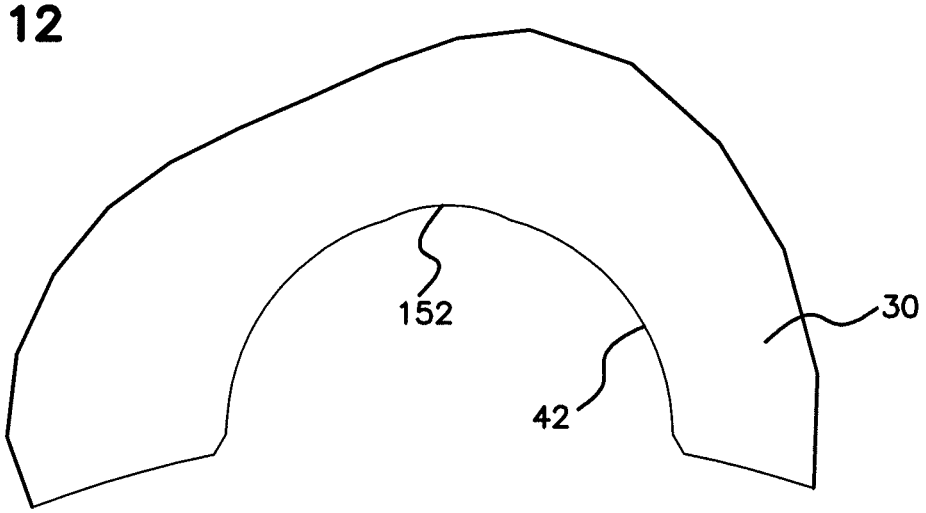
FIG. 12 is an enlarged fragmentary view of a roll pocket of the ring of FIG. 5.

Referring now to FIGS. 1 and 2, a fluid device 10 is shown. While the fluid device 10 can be used as a fluid pump or a fluid motor, the fluid device 10 will be described herein as a fluid motor.

In the depicted embodiment, the fluid device 10 includes a mounting plate 12, a displacement assembly 14, a valve plate 16 and a valve housing 18. While the fluid device 10 is shown in FIGS. 1 and 2 as having a bearingless configuration, the fluid device 10 could alternatively be configured to include an output shaft.

The fluid device 10 includes a first axial end 20 and an oppositely disposed second axial end 22. In the depicted embodiment, the mounting plate 12 is disposed at the first axial end 20 while the valve housing 18 is disposed at the second axial end 22. The displacement assembly 14 is disposed between the mounting plate 12 and the valve housing 18. The valve plate 16 is disposed between the displacement assembly 14 and the valve housing 18.

The mounting plate 12, the displacement assembly 14, the valve plate 16 and the valve housing 18 are held in tight sealing engagement by a plurality of fasteners 24 (e.g., bolt, screws, etc.). In the depicted embodiment, the fasteners 24 are in threaded engagement with threaded openings 25 in the mounting plate 12.

Referring now to FIGS. 2-5, the displacement assembly 14 is shown. The displacement assembly 14 includes a ring assembly 26 and a rotor 28.

The ring assembly 26 includes a ring 30 and a plurality of rolls 32. In the depicted embodiment, the ring 30 is rotationally stationary relative to the fluid device 10. The ring 30 is manufactured from a first material. In one embodiment, the first material is ductile iron. In another embodiment, the first material is grey iron. In another embodiment, the first material is steel. The ring 30 includes a first end face 34 that is generally perpendicular to a central axis 36 of the ring 30 and an oppositely disposed second end face 38. The ring 30 has a width W that is measured from the first end face 34 to the second end face 38.

The ring 30 defines a central bore 40 that extends through the first and second end faces 34, 38. The ring 30 further defines roll pockets 42 that are symmetrically disposed about the central bore 40. In the depicted embodiment, the ring 30 includes nine roll pockets 42. In another embodiment, the ring 30 includes seven roll pockets 42. Each of the roll pockets 42 defines a roll surface 44. The roll surface 44 is partially cylindrical in shape. In the depicted embodiment, each roll surface 44 extends a circumferential angular distance that is less than or equal to about 180 degrees. Each of the roll surfaces 44 is adapted for sliding engagement with one of the rolls 32.

The rolls 32 are disposed in the roll pockets 42 of the ring 30. Each of the rolls 32 defines a central axis 46 about which the corresponding roll 32 rotates. Each of the rolls 32 includes a first end face 48, an oppositely disposed second end face 50 and an outer surface 52 that extends between the first and second end faces 48, 50. The outer surface 52 is generally cylindrical in shape. Each of the rolls 32 has a width measured from the first end face 48 to the second end face 50. The width of the roll 32 is less than the width W of the ring 30.

The rotor 28 of the displacement assembly 14 is eccentrically disposed in the central bore 40 of the ring assembly 26. The rotor 28 is manufactured from a second material. In one embodiment, the second material is different from the first material. In one embodiment, the second material is steel. The rotor 28 includes a first end surface 54 and an oppositely disposed second end surface 56.

The rotor 28 includes a plurality of external tips 58 and a plurality of internal splines 60 that extend between the first and second end surfaces 54, 56. In the depicted embodiment, the number of external tips 58 on the rotor 28 is one less than the number of rolls 32 in the ring assembly 26. The rotor 28 is adapted to orbit about the central axis 36 of the ring 30 and rotate in the central bore 40 of the ring assembly 26 about an axis 62 of the rotor 28. The rotor 28 orbits N times about the central axis 36 of the ring 30 for every complete revolution of the rotor 28 about the axis 62 where N is equal to the number of external tips 58 of the rotor 28. In the depicted embodiment, the rotor 28 orbits eight times per every complete rotation of the rotor 28.

The ring assembly 26 and the external tips 58 of the rotor 28 cooperatively define a plurality of volume chambers 64. As the rotor 28 orbits and rotates in the ring assembly 26, the volume chambers 64 expand and contract.

Referring now to FIG. 2, the fluid device 10 includes a main drive shaft 66. The main drive shaft 66 includes a first end 68 having a first set of external splines 70 and an opposite second end 72 having a second set of external splines 74. In the depicted embodiment, the first and second sets of external splines 70, 74 are crowned. The internal splines 60 of the rotor 28 are in engagement with the first set of external splines 70. The second set of external crowned splines 74 is adapted for engagement with internal splines of a customer-supplied output device (e.g., a shaft, coupler, etc.).

In the depicted embodiment, the internal splines 60 of the rotor 28 are also in engagement with a first set of external splines 76 formed on a first end 78 of a valve drive 80. The valve drive 80 includes an oppositely disposed second end 82 having a second set of external splines 84. The second set of external splines 84 are in engagement with a set of internal splines 86 formed about an inner periphery of a valve member 88 that is rotatably disposed in a valve bore 90 of the valve housing 18. The valve drive 80 is in splined engagement with the rotor 28 and the valve member 88 to maintain proper timing between the rotor 28 and the valve member 88.

Referring now to FIGS. 2 and 6-8, the valve member 88 is shown as being of a disc-valve type. In alternative embodiments, the valve member 88 could be of the spool-valve type or a valve-in-star type. In the depicted embodiment, the valve member 88 includes a first axial end 92, an oppositely disposed second axial end 94 and a circumferential surface 96 that extends between the first and second axial ends 92, 94. The valve member 88 defines a first plurality of fluid passages 98 and a second plurality of fluid passages 100. The first and second pluralities of fluid passages 98, 100 are alternately disposed in the valve member 88. Each of the first plurality of fluid passages 98 has a first opening 102 at the first axial end 92 of the valve member 88. Each of the second plurality of fluid passages 100 has a second opening 104 at the first axial end 92 of the valve member 88. The first plurality of fluid passages 98 provides fluid communication between the first axial end 92 and the circumferential surface 96. The second plurality of fluid passages 100 provides fluid communication between the first axial end 92 and the second axial end 94.

Referring now to FIGS. 1 and 2, the valve housing 18 defines a first fluid port 106 and a second fluid port 108. The first fluid port 106 is in fluid communication with the valve bore 90 of the valve housing 18. The second fluid port 108 is in fluid communication with an annular cavity 110 that is disposed adjacent to the valve bore 90.

The first plurality of fluid passages 98 of the valve member 88 is in fluid communication with the valve bore 90. The second plurality of fluid passages 100 is in fluid communication with the annular cavity 110.

A valve-seating mechanism 112 biases the valve member 88 toward a valve surface 114 of the valve plate 16 so that the first axial end 92 of the valve member 88 contacts the valve surface 114 of the valve plate 16. A valve-seating mechanism suitable for use with the fluid device 10 has been described in U.S. Pat. No. 7,530,801, which is hereby incorporated by reference in its entirety.

Referring now to FIGS. 2 and 9-11, the valve plate 16 is shown. The valve plate 16 includes the valve surface 114 and an oppositely disposed ring surface 116.

The valve plate 16 defines a plurality of commutating passages 118. The number of commutating passages 118 is equal to the number of volume chambers 64 in the displacement assembly 14. In the depicted embodiment, the number of commutating passages 118 is equal to nine. The commutating passages 118 extend through the valve surface 114 and the ring surface 116 of the valve plate 16. Each of the commutating passages 118 includes a valve opening 120 at the valve surface 114 and a volume chamber opening 122 at the ring surface 116. In the depicted embodiment, the commutating passages 118 are aligned with the volume chambers 64 of the displacement assembly 14 when the valve plate 16 is disposed in the fluid device 10. Each commutating passage 118 is adapted to provide commutating fluid communication between the first and second pluralities of fluid passages 98, 100 of the valve member 88 and the corresponding volume chamber 64.

The valve plate 16 further defines a plurality of recesses 124. Each of the recesses 124 includes an opening 126 at the valve surface 114 of the valve plate 16. In the depicted embodiment, the recesses 124 do not extend through the ring surface 116. The recesses 124 and the commutating passages 118 are alternately disposed on the valve surface 114 of the valve plate 16.

As the valve member 88 rotates, the first axial end 92 of the valve member 88 slides in a rotary motion against the valve surface 114 of the valve plate 16. The valve member 88 and the valve plate 16 provide commutating fluid communication to the volume chambers 64 of the displacement assembly 14. When the fluid device 10 is operated as a fluid motor, pressurized fluid enters the volume chambers 64 through the commutating fluid communication between the valve member 88 and the valve plate 16. The pressurized fluid in the volume chambers 64 of the displacement assembly 14 generates torque which causes the rotor 28 to rotate and orbit in the ring assembly 26. As the rotor 28 rotates and orbits in the ring assembly 26, the main drive shaft 66 rotates.

Starting torque is a value that is measured in order to determine the starting capability of a fluid device. Starting torque is the amount of torque developed by a fluid motor on startup in response to pressurized fluid in the volume chambers. Typically, starting torque is less than running torque of the fluid motor. Starting torque is influenced by the mechanical efficiency of the fluid motor.

Referring now to FIGS. 2, 6-8 and 11-13, a pressurized roll pocket system 150 of the fluid device 10 is shown. The pressurized roll pocket system 150 is adapted to increase the mechanical efficiency of the fluid device 10 at startup and thereby increase the starting torque efficiency (defined as the measured starting torque divided by the theoretical starting torque) of the fluid device 10.

Each of the roll pockets 42 of the ring 30 of the displacement assembly 14 defines a channel 152. In one embodiment, the channel 152 extends at least a portion of the length of the roll 32. In another embodiment, the channel 152 extends the length of the roll 32. In another embodiment, the channel 152 extends through the first and second end faces 34, 38 of the ring 30. The channel 152 includes an opening at the roll surface 44. In the depicted embodiment, the channel 152 is generally aligned with a location in the roll pocket 42 having the greatest radial distance from the central axis 36 of the central bore 40.

In the depicted embodiment, the channel 152 is arcuate in shape. In the subject embodiment, the channel 152 includes a radius that is less than a radius of the roll pocket 42. When the roll 32 is disposed in the roll pocket 42, the channel 152 provides a clearance space 154 between the roll 32 and the roll pocket 42. The clearance space 154 is adapted to receive fluid.

Referring now to FIGS. 6-8 and 13, the fluid device 10 includes a plurality of fluid passages 156 that provides fluid communication between the fluid recesses 124 in the valve plate 16 and the channels 152. In the depicted embodiment, the fluid passages 156 are disposed in the valve plate 16. The fluid passages 156 extend through the fluid recesses 124 and the ring surface 116. Each of the fluid passages 156 includes a first opening 158 at the fluid recess 124 and a second opening 160 at the ring surface 116. In the depicted embodiment, the second openings 160 of the fluid passages 156 are aligned with the clearance space 154 at the first end face 34 of the ring 30.

In the depicted embodiment, each of the fluid passages 156 includes a fluid restriction 162. The fluid restriction 162 is a fixed orifice having an inner diameter that is less than an inner diameter of the fluid passage 156. The fluid restriction 162 is sized to substantially restrict fluid flow through the fluid passage 156 when the fluid device 10 is operated above a speed threshold. In one embodiment, the speed threshold is less than or equal to about 10 revolutions per minute (RPM). In another embodiment, the speed threshold is less than or equal to about 5 RPM. In another embodiment, the speed threshold is in a range of about 3 to about 5 RPM.

Referring now to FIGS. 2, 4, 6, 8, 12 and 13, the operation of the pressurized roll pocket system 150 of the fluid device 10 will be described. On startup of the fluid device 10, pressurized fluid is passed through a portion of the fluid passages 156 into the clearance spaces 154. The pressurized fluid acts against the rolls 32 and pushes the rolls 32 away from the roll surfaces 44 of the roll pockets 42. The pressurized fluid provides a lubrication layer between the roll surfaces 44 of the roll pockets 42 and the rolls 32. With the rolls 32 being pushed outwardly from the roll surfaces 44 of the roll pockets 42 and with a lubrication layer disposed between the roll surfaces 44 of the roll pockets 42 and the rolls 32, the rolls 32 are able to rotate about the central axes 46 of the rolls 32. This rotation of the rolls 32 about the central axes 46 of the rolls 32 during startup of the fluid device 10 increases the mechanical efficiency of the fluid device 10 as compared to a mechanical efficiency of a convention fluid motor in which the rolls do not rotate during startup.

As the fluid device 10 continues operating, the fluid restrictions 162 of the fluid passages 156 get saturated as the speed of the fluid device 10 increases above the speed threshold. As the fluid restrictions become saturated, fluid communication between the fluid passages 156 and the channel 152 become substantially blocked. As the speed of the fluid device 10 increases above the speed threshold, pressurized fluid in the channels 152, which is supplied through the fluid passages 156, is not required since the rolls 32 will rotate about their central axes 46 in the roll pockets 42.

Figure 14:
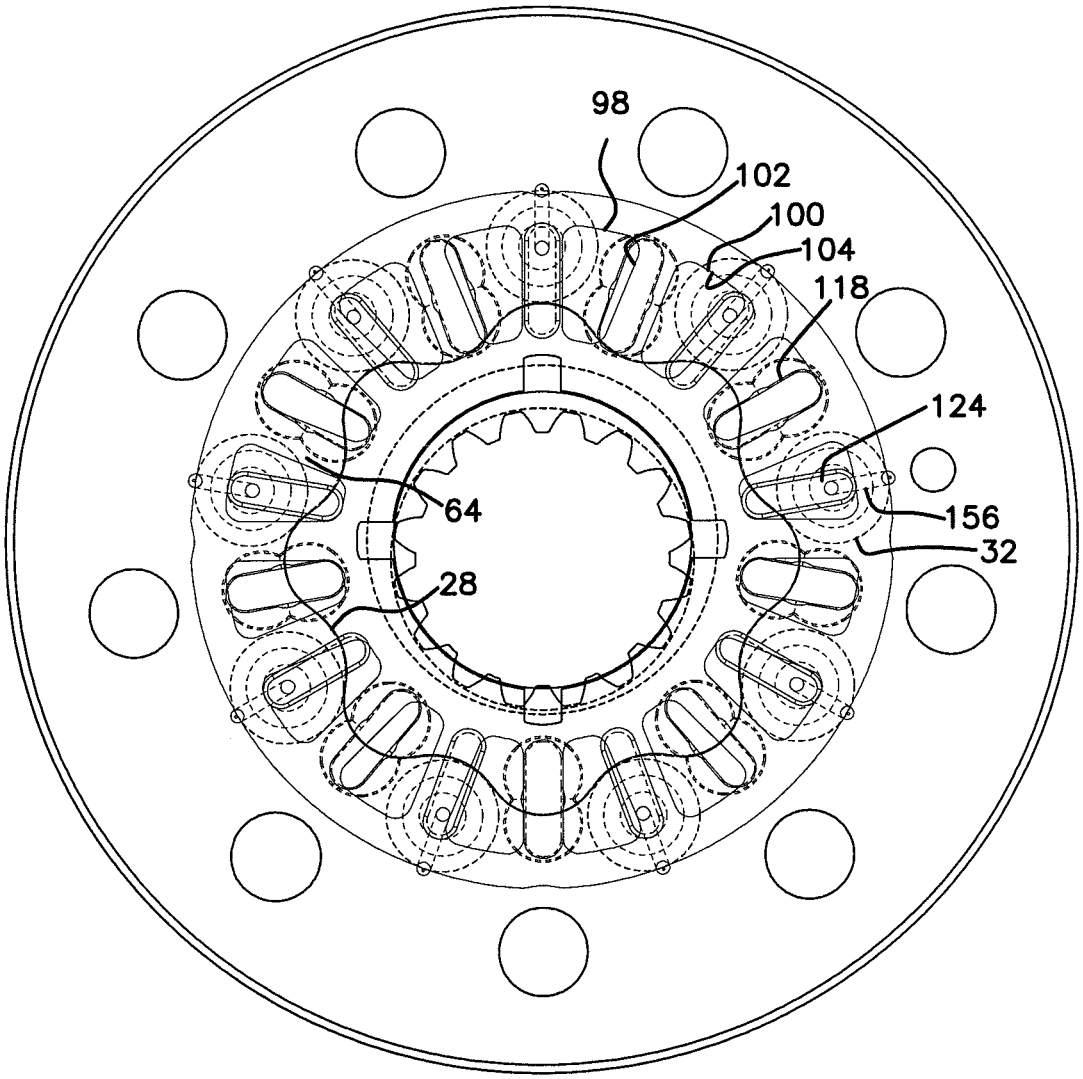
FIG. 14 is a diagram of fluid commutation between the valve member, the valve plate and the displacement assembly.

Referring now to FIGS. 1, 2, 3, 6-8, 11, 13 and 14, the commutation of fluid will be described. The fluid commutation diagram of FIG. 14 shows the interface between the first and second openings 102, 104 of the first and second pluralities of fluid passages 98, 100, respectively, of the valve member 88 and the plurality of commutating passages 118 and the plurality of recesses 124 in the valve plate 16. The fluid commutation diagram also shows the displacement assembly 14.

The first and second openings 102, 104 are alternately disposed on the first axial end 92 of the valve member 88. The first openings 102 are in fluid communication with the first port 106 of the valve housing 18 while the second openings 104 are in fluid communication with the second port 108 of the valve housing 18. In one example, the first port 108 receives fluid from a fluid source (e.g., a fluid pump) while the second port 108 communicates fluid to a fluid reservoir (e.g., tank).

As the valve member 88 rotates, the first and second openings 102, 104 provide fluid to the commutating passages 118, which provide fluid to the volume chambers 64, and the recesses 124, which provide fluid to the channels 152, in the valve plate 16. In the depicted embodiment, each commutating passage 118 of the valve plate 16 is in fluid communication with the first and second openings 102, 104 during a single orbit of the rotor 28 while each recess 124 is in fluid communication with the first and second openings 102, 104 during the single orbit of the rotor 28.

As the volume chambers 64 are in fluid communication with the commutating passages 118 and the channels 152 are in fluid communication with the recesses 124, each volume chamber 64 and channel 152 is in fluid communication with the first and second ports 106, 108 during a single orbit of the rotor 28. When the volume chamber 64 that is immediately before a roll pocket 42 and the volume chamber 64 that is immediately after the roll pocket 42 (hereinafter referred to as the volume chambers 64 that are immediately adjacent to the roll pocket 42) are both in fluid communication with one of the first and second ports 106, 108, the channel 152 of that roll pocket 42 is in fluid communication with the other of the first and second ports 106, 108. Therefore, when the volume chambers 64 that are immediately adjacent to the roll pocket 42 are both receiving fluid from one of the first and second ports 106, 108, the channel 152 of that roll pocket 42 is receiving fluid from the other of the first and second ports 106, 108.

When the volume chambers 64 that are immediately adjacent to a roll pocket 42 are subjected to fluid at high pressure (e.g., fluid from the first port 106), the rotor 28 is being pushed away from the roll 32 in that roll pocket 42. Therefore, it is not necessary to provide fluid at high pressure to the channel 152 of the roll pocket 42. However, when the volume chambers 64 that are immediately adjacent to a roll pocket 42 are subjected to fluid at low pressure (e.g., fluid from the second port 108), the rotor 28 is being pushed into the roll 32 in that roll pocket 42 from high pressure fluid acting on the other side of the rotor 28. Therefore, in order to increase the mechanical efficiency, fluid at high pressure is communicated to the channel 152 of that roll pocket 42.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A fluid device comprising:

a valve member defining a first plurality of fluid passages in fluid communication with a first fluid port of the fluid device and a second plurality of fluid passages in fluid communication with a second fluid port of the fluid device;

a displacement assembly in commutating fluid communication with the valve member, the displacement assembly including:

a ring defining a central bore and a plurality of roll pockets disposed about the central bore;

a plurality of rolls disposed in the plurality of roll pockets;

a rotor disposed in the central bore, the rotor being adapted to rotate and orbit in the central bore of the ring, wherein the ring, the plurality of rolls and the rotor define a plurality of expanding and contracting volume chambers; and wherein each of the roll pockets is alternatingly in fluid communication with the first and second ports of the fluid device during the rotation and orbiting of the rotor such that when the volume chambers immediately adjacent to one of the roll pockets are in fluid communication with one of the first and second ports, that roll pocket is in fluid communication with the other of the first and second ports, fluid from the first port being at different pressure from fluid from the second port; and a valve plate defining a plurality of commutating passages in fluid communication with the volume chambers and a plurality of valve plate fluid passages in fluid communication with the roll pockets.

2. The fluid device of claim 1, wherein each of the roll pockets includes a channel into which fluid is communicated.

3. The fluid device of claim 2, wherein the channel extends the length of the roll pocket.

4. The fluid device of claim 2, wherein the channel has a radius that is less than the radius of the roll pocket.

5. The fluid device of claim 1, wherein the valve plate fluid passages include a first opening disposed at a valve surface and a second opening disposed at a ring surface of the valve plate.

6. The fluid device of claim 1, wherein each of the valve plate fluid passages includes a fluid restriction.

7. The fluid device of claim 6, wherein the fluid restrictions are fixed orifices that restrict fluid communication to the roll pockets when a speed of the fluid device is greater than a speed threshold.

8. The fluid device of claim 7, wherein the speed threshold is less than or equal to 5 revolutions per minute.

9. The fluid device of claim 1, wherein the valve plate defines a plurality of recesses, the plurality of commutating passages and the plurality of recesses being alternately disposed in the valve plate, the valve plate fluid passages being in fluid communication with the plurality of recesses.

10. A fluid device comprising:

a valve housing defining a first fluid port and a second fluid port;

a valve member disposed in the valve housing, the valve member defining a first plurality of fluid passages in fluid communication with the first fluid port and a second plurality of fluid passages in fluid communication with the second fluid port, the valve member having a first axial end;

a valve plate having a valve surface that contacts the first axial end of the valve member, the valve plate defining a plurality of commutating passages and a plurality of recesses, the commutating passages in commutating fluid communication with the first and second pluralities of fluid passages of the valve member;

a displacement assembly in commutating fluid communication with the valve member, the displacement assembly including:

a ring defining a central bore and a plurality of roll pockets disposed about the central bore;

a plurality of rolls disposed in the plurality of roll pockets;

a rotor disposed in the central bore, the rotor being adapted to rotate and orbit in the central bore of the ring, wherein the ring, the plurality of rolls and the rotor define a plurality of expanding and contracting volume chambers; and wherein fluid from the first and second ports is alternatingly communicated to each of the roll pockets during the rotation and orbiting of the rotor so that when the volume chamber immediately before one of the roll pockets and the volume chamber immediately after that roll pocket are both in fluid communication with one of the first and second ports, that roll pocket is in fluid communication with the other of the first and second ports, fluid from the first port being at different pressure from fluid from the second port.

11. The fluid device of claim 10, wherein each of the roll pockets includes a channel into which fluid is communicated.

12. The fluid device of claim 11, wherein the channel extends the length of the roll pocket.

13. The fluid device of claim 10, wherein the valve plate defines a plurality of valve plate fluid passages in fluid communication with the roll pockets.

14. The fluid device of claim 13, wherein each of the valve plate fluid passages includes a fluid restriction.

15. The fluid device of claim 14, wherein the fluid restrictions are fixed orifices that restrict fluid communication to the roll pockets when a speed of the fluid device is greater than a speed threshold.

16. The fluid device of claim 15, wherein the speed threshold is less than or equal to 5 revolutions per minute.

17. A method for pressuring a roll pocket in a displacement assembly of a fluid device, the method comprising:

providing a fluid device having a displacement assembly including:

a ring defining a central bore and a plurality of roll pockets disposed about the central bore;

a plurality of rolls disposed in the plurality of roll pockets;

a rotor disposed in the central bore, wherein the ring, the plurality of rolls and the rotor define a plurality of expanding and contracting volume chambers as the rotor rotates and orbits in the central bore of the ring;

placing each of the volume chambers alternatingly in fluid communication with first and second ports of the fluid device as the rotor rotates and orbits in the central bore of the ring; and placing each of the roll pockets alternatingly in fluid communication with the first and second ports of the fluid device as the rotor rotates and orbits in the central bore of the ring such that when the volume chamber immediately before one of the roll pockets and the volume chamber immediately after that roll pocket are both in fluid communication with one of the first and second ports, that roll pocket is in fluid communication with the other of the first and second ports, fluid from the first port being at different pressure from fluid from the second port.

18. The method of claim 17, further comprising restricting fluid communicated to the roll pockets when a rotational speed of the fluid device exceeds a speed threshold.

19. The method of claim 18, wherein the speed threshold is less than or equal to 5 revolutions per minute.

20. The fluid device of claim 1, further comprising a valve drive engaged between the rotor and the valve member and configured to maintain timing between a rotation of the rotor and a rotation of the valve member.

21. The fluid device of claim 20, wherein:

the rotor and the valve member are configured and arranged such that each of the volume chambers is in fluid communication with the first port once and in fluid communication with the second port once during a single orbit of the rotor, and such that each of the roll pockets is in fluid communication with the first port once and in fluid communication with the second port once during the single orbit of the rotor, and when the volume chambers that are immediately adjacent to the roll pocket are subjected to fluid at a first pressure from the first port, the roll pocket is subjected to fluid at a second pressure from the second port, and, when the volume chambers that are immediately adjacent to the roll pocket are subjected to fluid at the second pressure from the second port, the roll pocket is subjected to fluid at the first pressure from the first port, the first and second pressures being different.

22. The fluid device of claim 10, further comprising a valve drive engaged between the rotor and the valve member and configured to maintain timing between a rotation of the rotor and a rotation of the valve member.

23. The fluid device of claim 22, wherein:

the rotor and the valve member are configured and arranged such that each of the volume chambers is in fluid communication with the first port once and in fluid communication with the second port once during a single orbit of the rotor, and such that each of the roll pockets is in fluid communication with the first port once and in fluid communication with the second port once during the single orbit of the rotor, and when the volume chambers that are immediately adjacent to the roll pocket are subjected to fluid at a first pressure from the first port, the roll pocket is subjected to fluid at a second pressure from the second port, and, when the volume chambers that are immediately adjacent to the roll pocket are subjected to fluid at the second pressure from the second port, the roll pocket is subjected to fluid at the first pressure from the first port, the first and second pressures being different.

* * * * *